US007768399B2

(12) United States Patent
Hachmann et al.

(10) Patent No.: US 7,768,399 B2
(45) Date of Patent: Aug. 3, 2010

(54) HOLDER FOR AT LEAST ONE OBJECT

(75) Inventors: Georg Hachmann, Berlin (DE); Hans-Joachim Rossa, Berlin (DE); Veit Bork, Berlin (DE); Manfred Porsche, Zepernick (DE); Thomas Genentz, Rüdersdorf (DE)

(73) Assignee: Inventory Systems GmbH, Berlin (DE)

( * ) Notice: Subject to any disclaimer, the term of this patent is extended or adjusted under 35 U.S.C. 154(b) by 327 days.

(21) Appl. No.: 11/721,037

(22) PCT Filed: Dec. 5, 2005

(86) PCT No.: PCT/DE2005/002219

§ 371 (c)(1),
(2), (4) Date: May 19, 2008

(87) PCT Pub. No.: WO2006/061009

PCT Pub. Date: Jun. 15, 2006

(65) Prior Publication Data

US 2008/0309489 A1 Dec. 18, 2008

(30) Foreign Application Priority Data

Dec. 7, 2004 (DE) ..... 20 2004 019 164 U
Feb. 17, 2005 (DE) ..... 20 2005 002 958 U
Aug. 31, 2005 (DE) ..... 20 2005 013 979 U

(51) Int. Cl.
*G08B 13/14* (2006.01)

(52) U.S. Cl. ..... 340/568.1; 340/568.8

(58) Field of Classification Search ..... 340/568.1, 340/568.8, 571, 687, 686.1; 439/135, 136; 40/642.02, 653, 654, 659; 211/54.1, 59.1, 211/59.3, 57.1, 123, 124
See application file for complete search history.

(56) References Cited

U.S. PATENT DOCUMENTS

| | | | | |
|---|---|---|---|---|
| 3,083,067 | A | 3/1963 | Vos et al | |
| 3,785,501 | A | 1/1974 | Canning | |
| 4,246,710 | A * | 1/1981 | Mixer | 40/651 |
| 4,474,300 | A | 10/1984 | Entis | |
| 5,009,334 | A | 4/1991 | Bodkins | |
| 5,317,859 | A | 6/1994 | Schneider et al. | |
| 5,613,621 | A | 3/1997 | Gervasi | |
| 5,671,362 | A | 9/1997 | Cowe et al. | |
| 5,671,851 | A | 9/1997 | Johnson et al. | |
| 5,711,432 | A | 1/1998 | Stein et al. | |
| 5,992,652 | A | 11/1999 | Springs | |
| 6,105,791 | A | 8/2000 | Chalson et al. | |
| 6,158,598 | A | 12/2000 | Josefsson | |
| 6,269,285 | B1 | 7/2001 | Mignault | |

(Continued)

FOREIGN PATENT DOCUMENTS

BE 1008382 4/1996

(Continued)

*Primary Examiner*—Toan N Pham
(74) *Attorney, Agent, or Firm*—Workman Nydegger

(57) ABSTRACT

The invention relates to a fixture (1) for at least one object, especially merchandise or packagings for merchandise. According to the invention, a means (21) for automatically determining the frequency with which said at least one object is removed from and/out of the fixture (1) and a control means (23) for transmitting at least one signal in accordance with the determined frequency of removal are provided.

41 Claims, 14 Drawing Sheets

U.S. PATENT DOCUMENTS

| | | | | |
|---|---|---|---|---|
| 6,896,543 | B2 * | 5/2005 | Fort et al. | 439/501 |
| 7,468,665 | B2 * | 12/2008 | Grundy | 340/568.1 |
| 2005/0168345 | A1 | 8/2005 | Swafford, Jr. et al. | |
| 2005/0269279 | A1 | 12/2005 | Hardy et al. | |
| 2005/0279722 | A1 | 12/2005 | Ali | |

FOREIGN PATENT DOCUMENTS

| | | |
|---|---|---|
| CH | 223095 | 8/1942 |
| CH | 265058 | 11/1949 |
| DE | 2 232 549 | 2/1973 |
| DE | 2 232 594 | 1/1974 |
| DE | 28 22 920 | 12/1978 |
| DE | 31 16 145 | 11/1982 |
| DE | 33 17 994 | 11/1983 |
| DE | 84 26 651.1 | 2/1985 |
| DE | 34 01 671 | 7/1985 |
| DE | 36 08 695 | 9/1986 |
| DE | 36 28 609 | 2/1988 |
| DE | 36 41 425 | 6/1988 |
| DE | 44 34 420 | 3/1995 |
| DE | 295 13 747 | 8/1995 |
| DE | 195 35 045 | 3/1997 |
| DE | 298 11 796 | 7/1998 |
| DE | 19745813 | 4/1999 |
| DE | 198 08 475 | 9/1999 |
| DE | 100 20 847 | 10/2001 |
| DE | 696 26 968 | 1/2004 |
| DE | 20 2004 011758 | 10/2004 |
| DE | 20 2004 018 632 | 3/2005 |
| DE | 10 2004 027 151 | 4/2005 |
| DE | 20 2005 002 958 | 5/2005 |
| DE | 103 58 950 | 7/2005 |
| DE | 20 2005 010 088 | 9/2005 |
| EP | 0 048 479 | 3/1982 |
| EP | 0 806 749 | 11/1997 |
| EP | 0 808 119 | 3/2003 |
| EP | 1 541 064 | 6/2005 |
| EP | 1 579 789 | 9/2005 |
| FR | 2 489 792 | 3/1982 |
| FR | 2 581 304 | 11/1986 |
| GB | 2 180 527 | 4/1987 |
| JP | 59031202 | 2/1984 |
| JP | 01056014 | 3/1989 |
| JP | 02206407 | 8/1990 |
| JP | 03039107 | 2/1991 |
| JP | 03272708 | 12/1991 |
| JP | 04129506 | 4/1992 |
| JP | 05095827 | 4/1993 |
| JP | 05184442 | 7/1993 |
| JP | 05305021 | 11/1993 |
| JP | 07011714 | 1/1995 |
| JP | 07136025 | 5/1995 |
| JP | 07231839 | 9/1995 |
| JP | 07241228 | 9/1995 |
| JP | 07303550 | 11/1995 |
| JP | 07327795 | 12/1995 |
| JP | 08010113 | 1/1996 |
| JP | 08033541 | 2/1996 |
| JP | 08066247 | 3/1996 |
| JP | 08098751 | 4/1996 |
| JP | 08-173281 | 7/1996 |
| JP | 08202274 | 8/1996 |
| JP | 08242986 | 9/1996 |
| JP | 09056539 | 3/1997 |
| JP | 09075185 | 3/1997 |
| JP | 09084669 | 3/1997 |
| JP | 09135753 | 5/1997 |
| JP | 09135755 | 5/1997 |
| JP | 09238793 | 9/1997 |
| JP | 09238794 | 9/1997 |
| JP | 09285369 | 11/1997 |
| JP | 10052339 | 2/1998 |
| JP | 10057202 | 3/1998 |
| JP | 10066634 | 3/1998 |
| JP | 10094463 | 4/1998 |
| JP | 10099169 | 4/1998 |
| JP | 10137064 | 5/1998 |
| JP | 10151054 | 6/1998 |
| JP | 10155611 | 6/1998 |
| JP | 10211066 | 8/1998 |
| JP | 10225346 | 8/1998 |
| JP | 10286151 | 10/1998 |
| JP | 10304954 | 11/1998 |
| JP | 10313955 | 12/1998 |
| JP | 11000245 | 1/1999 |
| JP | 11004738 | 1/1999 |
| JP | 11018889 | 1/1999 |
| JP | 11018892 | 1/1999 |
| JP | 11032879 | 2/1999 |
| JP | 11046941 | 2/1999 |
| JP | 11056546 | 3/1999 |
| JP | 11076012 | 3/1999 |
| JP | 11192140 | 7/1999 |
| JP | 11244106 | 9/1999 |
| JP | 2000041797 | 2/2000 |
| JP | 2000041806 | 2/2000 |
| JP | 2000070085 | 3/2000 |
| JP | 2000070087 | 3/2000 |
| JP | 2000083774 | 3/2000 |
| JP | 2000116475 | 4/2000 |
| JP | 2000152859 | 6/2000 |
| JP | 2000157382 | 6/2000 |
| JP | 2000175783 | 6/2000 |
| JP | 2000217675 | 8/2000 |
| JP | 2000225044 | 8/2000 |
| JP | 2000296025 | 10/2000 |
| JP | 2000296038 | 10/2000 |
| JP | 2000333799 | 12/2000 |
| JP | 2000350647 | 12/2000 |
| JP | 2000354528 | 12/2000 |
| JP | 2000354530 | 12/2000 |
| JP | 2001008800 | 1/2001 |
| JP | 2001037567 | 2/2001 |
| JP | 2001061617 | 3/2001 |
| JP | 2001061619 | 3/2001 |
| JP | 2001124018 | 5/2001 |
| JP | 2001128816 | 5/2001 |
| JP | 2001137088 | 5/2001 |
| JP | 2001292873 | 10/2001 |
| JP | 2001299516 | 10/2001 |
| JP | 2001299526 | 10/2001 |
| JP | 2001309836 | 11/2001 |
| JP | 2001314291 | 11/2001 |
| JP | 2001-340184 | 12/2001 |
| JP | 2002-085213 | 3/2002 |
| JP | 2002065421 | 3/2002 |
| JP | 2002095562 | 4/2002 |
| JP | 2002162905 | 6/2002 |
| JP | 2002276630 | 9/2002 |
| JP | 2002291590 | 10/2002 |
| JP | 2002300943 | 10/2002 |
| JP | 2002330848 | 11/2002 |
| JP | 2002336097 | 11/2002 |
| JP | 2002369735 | 12/2002 |
| JP | 2003177671 | 6/2003 |
| JP | 2003180468 | 7/2003 |
| JP | 2003219938 | 8/2003 |
| JP | 2003259924 | 9/2003 |
| JP | 2003265282 | 9/2003 |
| JP | 2003284631 | 10/2003 |

| | | |
|---|---|---|
| JP | 2003310402 | 11/2003 |
| JP | 2004057325 | 2/2004 |
| JP | 2004057407 | 2/2004 |
| JP | 2004057774 | 2/2004 |
| JP | 2004-180918 | 7/2004 |
| JP | 2004261458 | 9/2004 |
| JP | 2004329402 | 11/2004 |
| JP | 2004331131 | 11/2004 |
| JP | 2005021421 | 1/2005 |
| JP | 2005040211 | 2/2005 |
| JP | 2005074173 | 3/2005 |
| JP | 2005087225 | 4/2005 |
| JP | 2005087593 | 4/2005 |
| JP | 2005103105 | 4/2005 |
| JP | 2005152389 | 6/2005 |
| JP | 2005-192586 | 7/2005 |
| JP | 2005192767 | 7/2005 |
| JP | 2005211241 | 8/2005 |
| JP | 2005245954 | 9/2005 |
| JP | 2005245955 | 9/2005 |
| WO | WO 94/24906 | 11/1994 |
| WO | 00/61438 | 10/2000 |
| WO | 03/039301 | 5/2003 |
| WO | 2006/061009 | 6/2006 |

* cited by examiner

HOLDER FOR AT LEAST ONE OBJECT

The invention relates to a holder for at least one object according to the preamble of claim 1.

It is often necessary to store individual objects on a holder, the intention being for the objects to be removed in a controlled manner.

A typical application area for such holders is the display of articles or packs in retail shops. If separate articles are to be displayed clearly, they are often arranged on rod-like retaining means, from which the customer can easily remove the articles. The article or the pack, for this purpose, has an opening in which the rod-like holder can engage. Such displays are typically used for batteries, condoms or razor blades. It is also the case, however, that small electronic parts and articles are being displayed more and more on such rod-like holders.

All of these articles have in common the fact that they are relatively expensive, in which case they are targeted by shoplifters. This is because, in the case of the known holders, it is readily possible, in one movement, to remove a large number of the articles or packs from the holder and secrete them in a pocket. This is highly detrimental to retailers, and is compensated for in part by such articles only being available from sales staff; this is costly.

German Utility Model 20 2004 011 758.4 discloses a holder with a retaining means and a plurality of objects fastened on the retaining means. A mechanical barrier which is coupled to the retaining means is provided here. The barrier, in a blocking position, prevents the intended removal of an object from the retaining means and, in a removal position, allows the intended removal of an object from a retaining means. If the barrier is moved from the blocking position into the removal position, an acoustic signal sounds, this indicating that the barrier has been actuated.

The object of the present invention is to provide an alternative device which straightforwardly renders the unauthorized large-scale removal of articles or packs more difficult.

This object is achieved according to the invention by a holder having the features of claim 1.

The holder has a means for automatically determining the removal frequency at which at least one object is removed from and/or out of the holder. It is thus possible to determine whether an object is being removed and how often this takes place. In dependence on the removal frequency determined, a control means for transmitting at least one signal is then activated. This device can thus determine whether in particular unauthorized removal operations are taking place.

It is advantageous here if at least one signal is emitted automatically if at least one predetermined threshold value for the removal frequency is exceeded. It is typical of inadmissible removal operations that a large number of objects (e.g. packs) are taken out of, or from, a holder in a very short period of time.

It is advantageous, for example, if the threshold value is a removal frequency of more than 3 removal operations every 5 seconds for removing an object from and/or out of the holder. It may also be advantageous if the threshold value is a removal frequency of more than 7 removal operations every 30 seconds for removing an object from and/or out of the holder. The possibilities of combining different threshold values with one another and linking them together with other criteria gives a high level of flexibility.

The signal is advantageously a loud acoustic signal in the vicinity of the holder and/or an optical signal in the vicinity of the holder. This immediately deters, for example, a shoplifter. As an alternative, or else in addition, it may be advantageous if at least one signal is an acoustic and/or optical signal at a monitoring location remote from the holder. It is thus possible to inform, for example, the branch management.

Furthermore, it is advantageous if at least one signal is a wireless radio signal, in particular an SMS message, a pager message, an e-mail and/or a radio message. It is thus possible to communicate further information regarding the location and the time.

It is particularly advantageous if a signal is a triggering signal for a monitoring camera and/or a monitor. It is thus possible, for example, for branch management to locate a shoplifter immediately on the monitor.

The means for automatically determining the removal frequency is advantageously coupled to a clock, in which case the at least one signal is triggered in dependence on the time. This allows account to be taken of alarms outside the shop-opening hours.

Since a large number of packs are arranged on hooks, it is advantageous if the object has at least one retaining opening, in which case a retaining means of the holder can be guided through the retaining opening and retains the object.

The at least one retaining means is advantageously coupled to a mechanical device which is intended for separating the operations for removing an object and is coupled to the at least one means for automatically determining the removal frequency via an electromagnetic, magnetic, electronic and/or optical signal.

It is possible here for the mechanical device for separating objects to be in the form of a removal opening of the holder. This is the case, for example, with a box-like holder. It is advantageous here if a removal opening is arranged beneath an introduction opening for the object, in which case the objects, under the action of gravitational force, are arranged in front of the removal opening.

In the case of an advantageous embodiment, the means for automatically determining the removal frequency has a reed contact. It is thus easily possible to make and break contacts by which the removal frequency can be determined.

It is also advantageous if at least one mechanical barrier, in a removal position, allows the intended removal of an object from the retaining means and, in a blocking position, prevents the intended removal of an object from the retaining means.

The barrier here is designed such that it is moved automatically from the removal position into the blocking position by the proper removal of an object from the at least one retaining means. It is thus not possible for more than one object to be taken at any one time from the retaining means since, upon removal of the first object, the barrier is moved automatically into the blocking position, in which it prevents any further object from being removed. Prior to the removal of a second object, the barrier thus first of all has to be moved back into the removal position, in which a further object can be taken from the retaining means.

Using a mechanical barrier means that it is not necessary for the holder to be connected to a mains supply or for batteries to be used. Both of these options would increase the outlay related to maintenance and installation.

In one embodiment, the barrier is mounted for rotation about an axis such that it is moved from the removal position into the blocking position by a rotary movement about the axis upon proper removal of an object from the retaining means. The rotary movement about the axis can advantageously be realized straightforwardly and, at the same time, provides sufficient clearance for movement between the removal position and the blocking position.

The barrier preferably has a protrusion which, in the removal position, projects out of the retaining means such that it is subjected to mechanical contact, and moved, by the object upon proper removal of the latter from the retaining means, as a result of which the barrier is moved into the blocking position. Upon removal from the retaining means, the object strikes against the protrusion, as a result of which the barrier is caused to move from the removal position into the blocking position.

In a not-in-use position, the barrier advantageously moves automatically into the removal position. "Not-in-use position" is intended to be understood as a state in which, rather than being moved or retained, the barrier is not being used. The barrier then moves automatically back into the removal position, e.g. following removal of an object.

In one embodiment, the barrier, in the blocking position, has at least one dimension which is larger than the opening of the object, in which case the retaining means cannot be moved through the opening in the blocking position. This means that the object cannot be taken from the retaining means and thus cannot be withdrawn from the holder in the blocking position.

In a particularly preferred embodiment, the barrier has at least one blocking leg and a swing-action leg, which are coupled mechanically to one another. The coupling either can be brought about by the blocking leg and swing-action leg being formed in one piece or by these legs being connected to one another in a form-fitting, force-fitting or integrally locking manner. The swing-action leg here serves as a driver when an object is removed from the retaining means, the movement of the driver causing the barrier to move from the removal position into the blocking position. The blocking leg, in the blocking position, obstructs the removal of a further object from the retaining means.

The swing-action leg here is preferably designed to be heavier and longer than the blocking leg in order, in the not-in-use position, to be oriented in the direction of the ground under the action of gravitational force. The barrier is thus moved into the removal position.

The holder here is advantageously designed as a U-shaped double hook, between which at least one leg of the barrier can be moved. In the removal position, for example the blocking leg is arranged essentially between the U-shaped double hook, and the swing-action leg is possibly arranged here in the blocking position.

The swing-action leg here is preferably designed as an information carrier, in particular for a price tag, and thus performs two functions at the same time.

In one embodiment, the holder has a stop for the barrier, this stop limiting movement of the barrier, in the removal position, in at least one direction and thus regulating and securing the position of the barrier in the removal position.

The barrier here is preferably arranged at that end of the retaining means via which the object is moved upon proper removal from the retaining means. This maximizes the amount of space on the retaining means which is available for retaining the objects.

In a particularly preferred embodiment, the barrier is of L-shaped design, the two L-legs being in the form of a swing-action leg and a blocking leg. The blocking leg, in the removal position, is recessed in a groove of the retaining means. When an object is removed, the swing-action leg is pivoted about an axis of rotation such that it moves into a position in which it is oriented parallel to the retaining means and in which the blocking leg is oriented vertically away from the retaining means, and thus prevents any further object from being removed from the retaining means.

In one embodiment, an acoustic signal is generated when the barrier is moved from the removal position into the blocking position. The removal of an object from the retaining means is indicated, by the signal, to anyone within hearing distance of the holder. The removal of each individual object from the retaining means is thus accompanied by a warning sound since, in the blocking position of the barrier, it is not possible for any further object to be taken from the holder. The signal sound can be triggered, for example, by an acoustic signal transmitter being subject to electronic contact, in the blocking position, by the swing-action leg. As an alternative, it would also be possible for a mechanical signal transmitter, e.g. a bell, to be struck, in the blocking position, by the swing-action leg.

In a further embodiment, the means for automatically determining the removal frequency is coupled to a means for monitoring stock. The removal frequency can thus be used in order to establish possible stock shortages in the holder.

The invention is presented in more detail hereinbelow by way of a number of exemplary embodiments and with reference to the figures of the drawings, in which.

In the figures, corresponding and similar features have the same designations.

FIG. 1 illustrates a side view of a detail of a first embodiment of the holder according to the invention, comprising a retaining means 1. The retaining means 1 is intended to accommodate packs or objects 10 (not illustrated here), e.g. blister packs, printer cartridges, batteries or razor blades (see FIGS. 2 and 5 in this respect). Such packs 10 have, as is known, a retaining opening, in which case the packs 10 can be pushed onto the rod-like, e.g. metallic, retaining means 1.

The problem is that these high-value packs 10 can easily be pushed off the rod-like retaining means 1, in which case it is readily possible for a large quantity of high-value articles to be stolen.

Figure 4:
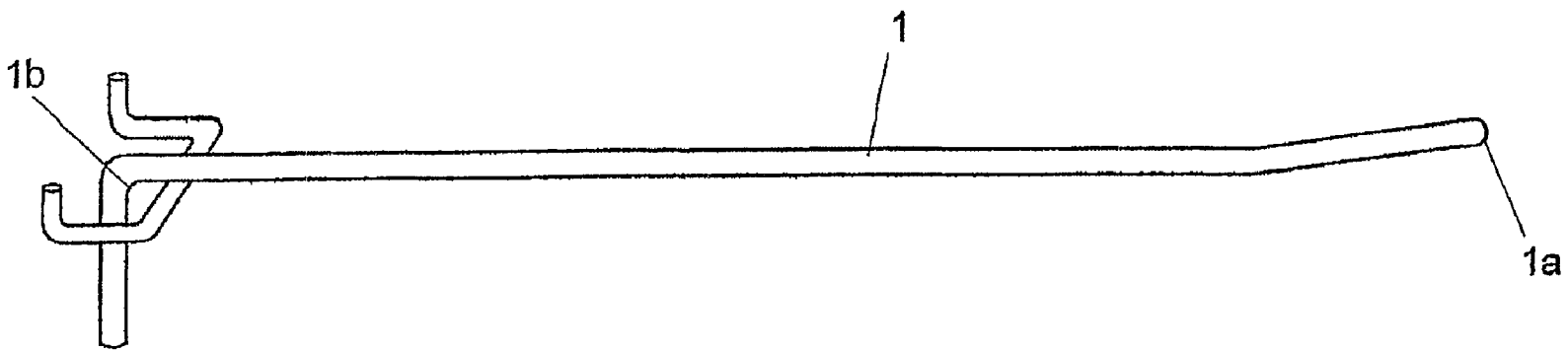
FIG. 4 shows a schematic illustration of a conventional retaining means without a barrier.

FIG. 4 illustrates a known retaining means 1 without a barrier. The packs 10 can be pushed onto the essentially rod-like retaining means 1. It is also possible, in principle, for the retaining means to comprise a plurality of rods or a wire loop, which can engage in the opening of the packs 10. At one end 1*b*, on the left-hand side in FIG. 4, the retaining means 1 is fastened on a wall or a rack.

At the opposite, open end 1*a*, the retaining means 1 is curved upward, in which case the packs 10 cannot slide off accidentally from the retaining means 1. This curvature alone, however, does not ensure better safeguarding against theft. The retaining means is thus designed essentially as a hook which may be arranged, for example, as a rack hook, on a corresponding wall in the sales area. The packs or objects 10 are fitted onto the holder, by way of their opening, via the open end 1*a*.

Figure 1A:
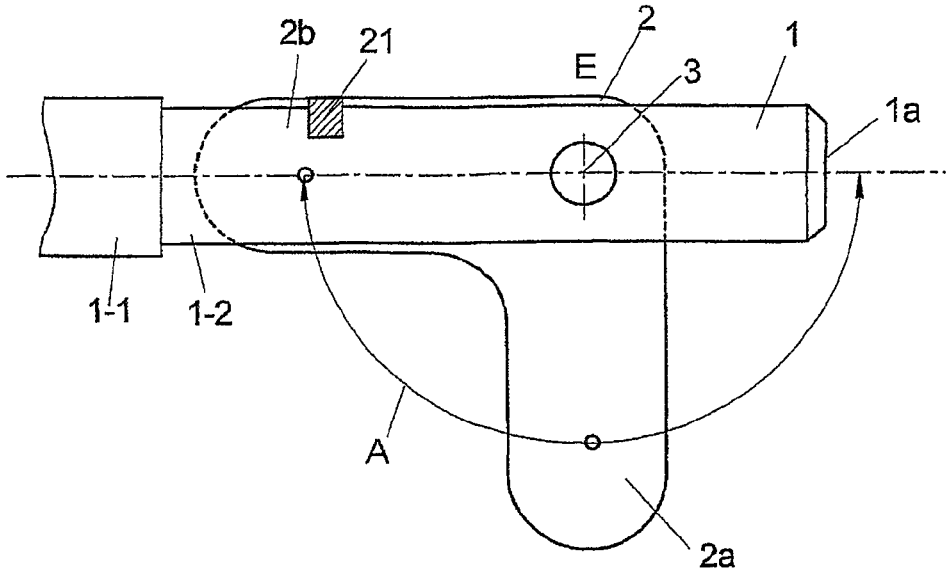
FIG. 1A shows a schematic side view of one end of a retaining means, at which an L-shaped barrier, in a removal position, is oriented such that its swing-action leg is directed downward.
Figure 1B:
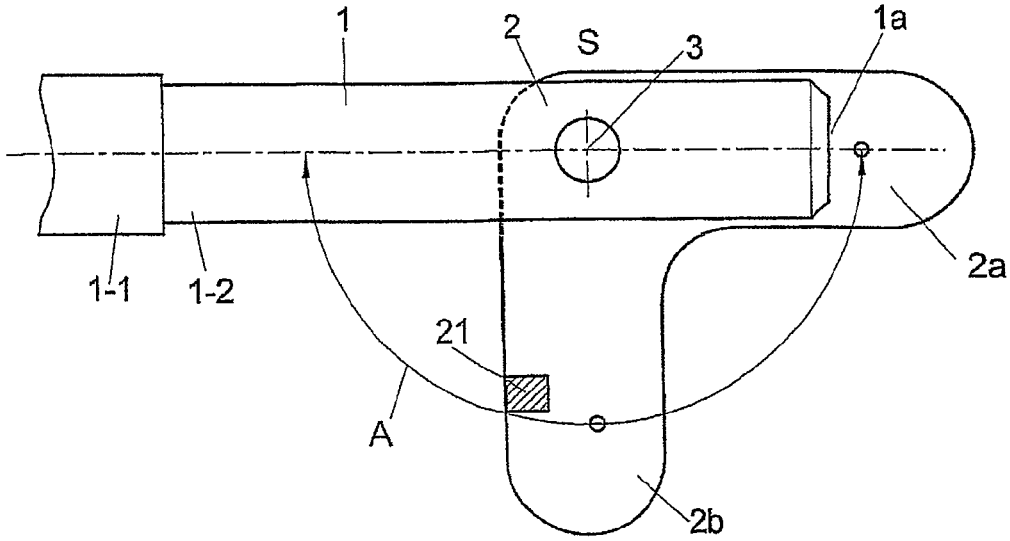
FIG. 1B shows a schematic side view of the retaining means from FIG. 1A with the barrier in a blocking position, in which a blocking leg of the barrier prevents any further object from being removed.
Figure 2:
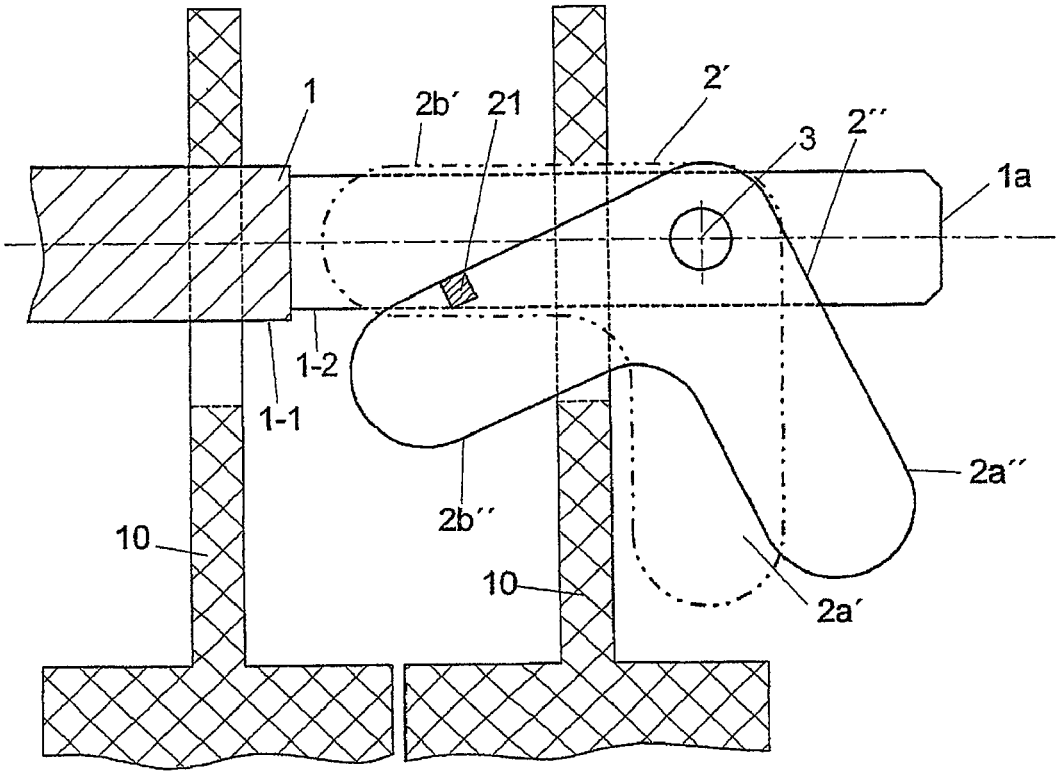
FIG. 2 shows a schematic section through the retaining means from FIGS. 1A and 1B during removal of an object, the barrier being pivoted about its axis of rotation.
Figure 3:
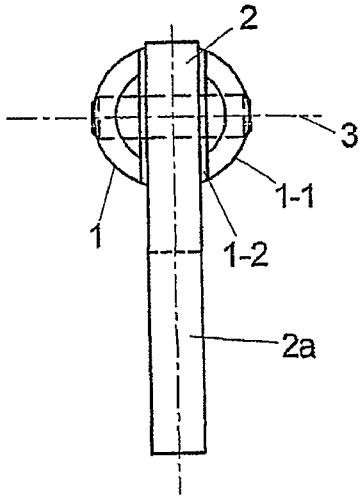
FIG. 3 shows a schematic front view of the retaining means from FIG. 1A as seen in the direction in which the retaining means is oriented.

In FIGS. 1 to 3, in contrast to FIG. 4, a mechanical barrier 2 is arranged at the open end 1*a* of the retaining means 1, and this barrier prevents more than one object 10 from being removed from the retaining means 1. This thus constitutes a means of separating the operations for removing objects 10.

The elongate retaining means 1 is illustrated in these figures as a rack hook, of which the end which is not illustrated is fastened on a wall and which has the L-shaped single-part barrier 2 formed at its open end 1*a*. The barrier 2 is fixed to the retaining means 1 and forms a single component therewith. Since it is precisely the barrier which is brought into use, and thus subjected to loading, during each operation of removing an object from the retaining means, it is precisely this stable embodiment which is particularly advantageous for the loading capability of the holder.

In a normal position the packs 10 are arranged in a region of the holder which is bounded by the barrier 2 at the open end 1*a*, at which the packs 30 can be removed from the retaining means 1.

The two L-legs of the barrier 2 are designed as a swing-action leg 2*a* and a blocking leg 2*b*. At the L-vertex, the barrier 2 is mounted such that it can be pivoted about an axis of rotation 3 which is oriented perpendicularly to the retaining means 1 and parallel to the floor (not illustrated).

In a removal position E of the barrier 2, this position being shown in FIG. 1A, the swing-action leg 2*a* is directed essentially vertically downward and thus vertically away from the horizontally arranged and oriented retaining means 1. Since the swing-action leg 2*a* is designed to be heavier (for example longer) than the blocking leg 2*b*, in a not-in-use position, the barrier 2 rotates automatically, under the action of gravitational force, into this removal position E, in which the blocking leg 2*b* is oriented essentially parallel to the retaining means 1 and does not obstruct the removal of objects 10 from the retaining means 1.

The blocking leg 2*b* here is recessed in a groove of the retaining means 1.

When an object 10 is removed from the retaining means 1, that is to say when the object 10 is moved over the open end 1*a* of the retaining means 1, the swing-action leg 2*a* is pivoted about the axis of rotation 3, as a result of contact with the object 10, such that it passes into a position in which it is oriented essentially parallel to the retaining means 1 (cf. FIG. 1B). The blocking leg 2*b* here is oriented essentially vertically away from the retaining means 1 and thus prevents any further object 10 from being removed from the retaining means 1, since the extent of the blocking leg 2*b* is larger than the opening of the object 10. In FIG. 1B, the barrier 2 is thus located in a blocking position S.

According to the invention, in this first embodiment, a contact element 21, which is part of a means for determining the removal frequency of the objects, is arranged in the region of the blocking leg 2*b*. The contact element 21 is coupled to a control means 23 which, in the case of inadmissible large-scale removal (see FIG. 9 for a complete illustration), can trigger a signal 50. The contact element 21 here is a magnetic element.

FIG. 2 shows the open end 1A of the retaining means 1, this end already having been illustrated in FIGS. 1A and 1B, two objects in packs 10 hanging on the retaining means 1. FIG. 2 illustrates how the barrier 2' is moved out of its removal position into a displaced position 2" by an object 10 being moved in the direction of the open end 1*a*. The barrier rotates about the axis 3 here. If the object 10 is pulled all the way over the open end 1*a*, the L-shaped barrier 2' or 2" is moved all the way into the blocking position S (cf. FIG. 1B) and, when the object 10 is removed, it swings back into the removal position E (cf. FIG. 1A).

FIG. 3 shows a schematic front view of the retaining means 1 from FIGS. 1A, 1B and 2 as seen in the direction in which the retaining means 1 is oriented. FIG. 3 shows a view of the open end 1A of the retaining means 1. The swing-action leg 2*a* of the barrier 2 here is oriented vertically downward and projects out of the retaining means 1. In contrast to the normal region 1-1 of the retaining means 1, the last section in front of the open end 1*a* is in the form of a thinned region. The thinned region 1-2, as can be seen in FIG. 3, is grooved such that both the blocking leg 2*b* and the swing-action leg 2*a* of the barrier 2 can engage in the thinned region 1-2 of the retaining means 1. It can thus swing about the axis 3 without obstruction. A grooved end of the thinned region 1-2 is advantageous in that the blocking leg 2*b*, in the removal position E, and the swing-action leg 2*a*, in the blocking position S, can be recessed in the interior of the retaining means 1 such that they do not obstruct movement of the object 10.

Figure 5:
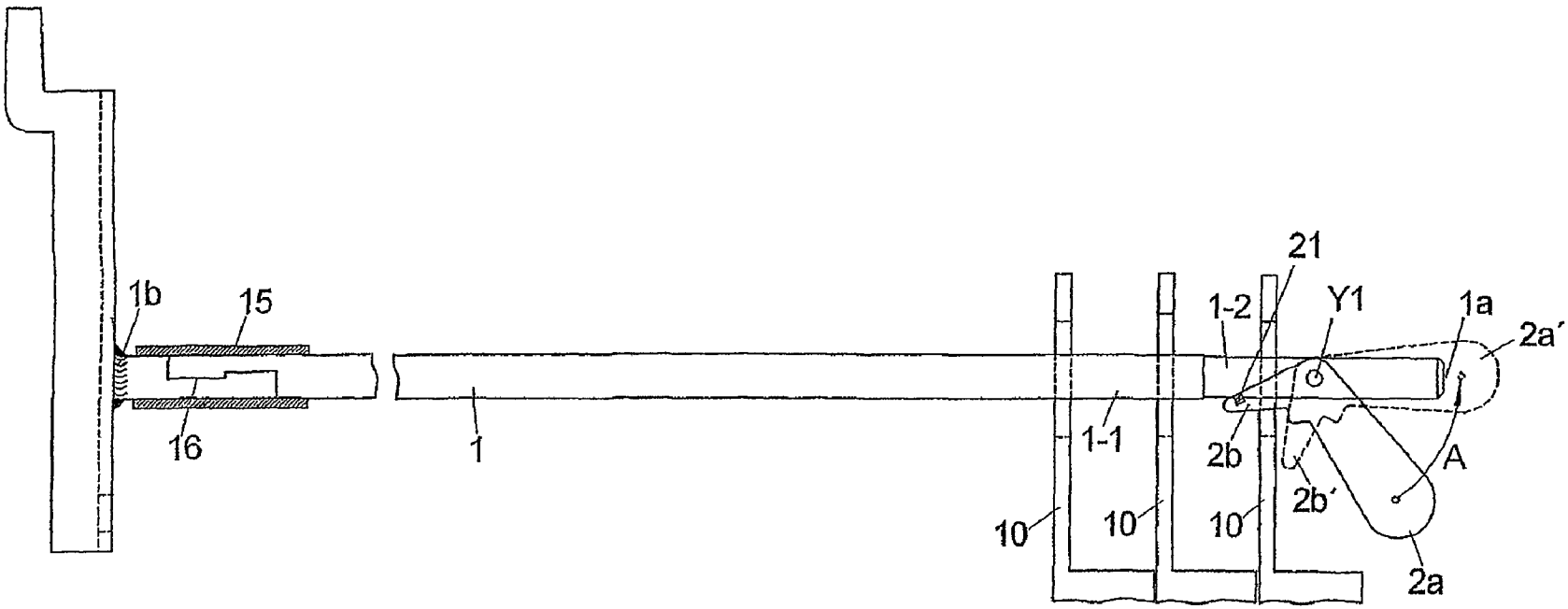
FIG. 5 shows a schematic section through a retaining means with an L-shaped barrier with an enlarged swing-action leg arranged at one end.

FIG. 5 shows a further exemplary embodiment of a holder with a barrier 2. The retaining means 1 here has a barrier 2 of which the swing-action leg 2*a* is designed to be longer, wider and heavier than the blocking leg 2*b*. As a result, the swing-action leg 2*a*, in the removal position, is always oriented essentially downward, in the direction of the earth's center, under the action of gravitational force. The barrier 2, once again, can be recessed in a groove of the thinned region 1-2. In order for the retaining means 1 to be fastened on the wall at its wall end 1*b*, the retaining means 1 is of two-part design. A separating line 16 at the wall end 1*b* divides the retaining means 1 into two parts which can be fitted together and can be fastened on one another by means of a threaded sleeve nut 15. The threaded sleeve nut 15 encloses the retaining means 1 all the way along the diameter.

Figure 6A:
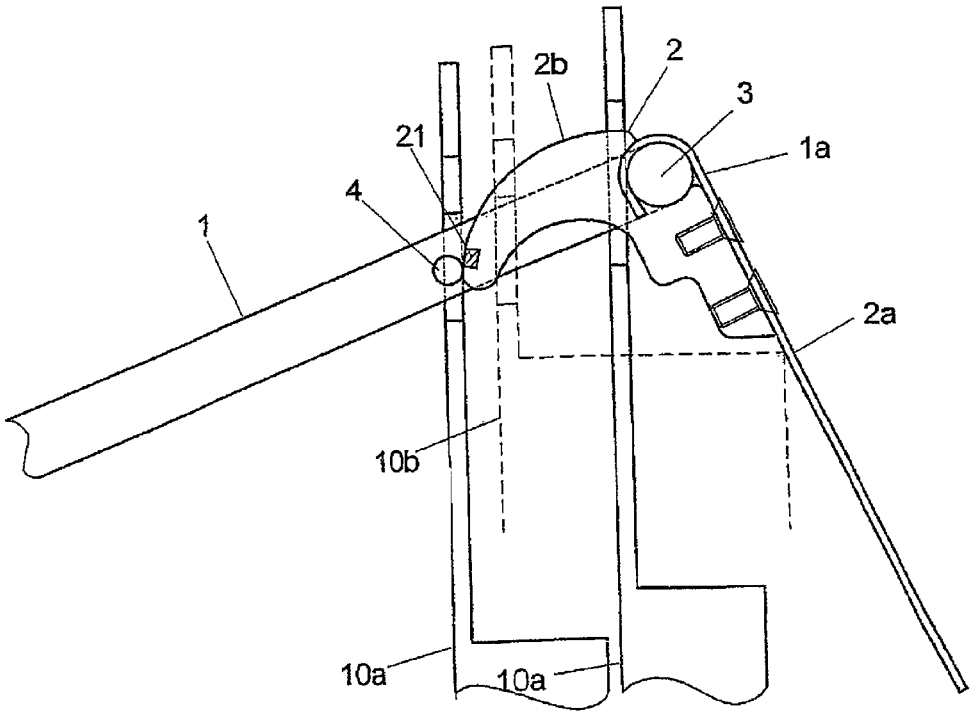
FIG. 6A shows a schematic section through a retaining means with an L-shaped barrier arranged at its open end, the swing-action leg being designed as a price tag.
Figure 6B:
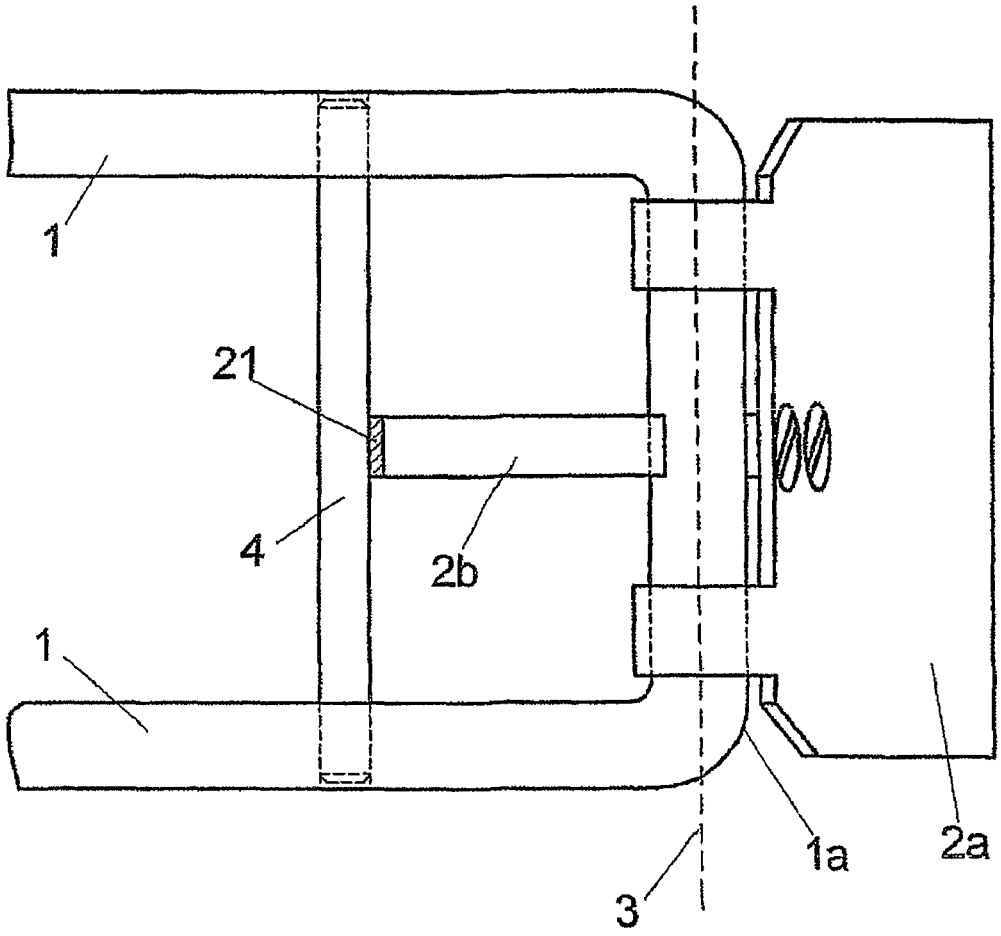
FIG. 6B shows a schematic plan view of the retaining means from FIG. 6A.

FIGS. 6A and 6B show a further embodiment of a retaining means 1, the retaining means 1 in these figures comprising a U-shaped wire loop or double rack hook with the "underside of the U" arranged at the open end 1A.

The barrier 2 is of essentially L-shaped design. The swing-action leg 2*a* here is designed as a price tag. However, it is also possible, in principle, for the swing-action leg 2*a* to serve as an information carrier for other information, e.g. color codes in shops for identifying the articles more easily. As is conventional with holders, a price tag indicating the price of the objects 10 located on the retaining means 1 is arranged at the open end 1*a* of the retaining means 1. The price tag 2*a* is designed such that it can be pivoted about the axis 3, the axis 3 running through the underside "of the U" of the U-shaped double hook 1. When an object is removed, the price tag 2*a* is moved in order to allow the object 10 to be withdrawn and/or removed from the retaining means 1.

The blocking leg 2*b* is fixed in a rigidly connected manner to the price tag 2*a*. When the price tag is pivoted, the blocking leg 2*b* of the barrier 2 is moved out of the removal position into the blocking position. In the removal position, the blocking leg 2*b* is arranged between the double rack hooks 1.

The blocking leg 2*b* here is curved and of such a length that, both for objects in normal-sized packs 10*a* and for objects in oversized packs 10*b*, it is transferred into the blocking position S following removal of precisely one object 10*a* or 10*b*. The pack 10*a* or 10*b*, upon removal, first comes into contact with the swing-action leg (in the form of the price tag) 2*a* when it is located in its entirety between the wall end of the blocking leg 2*b* and the swing-action leg 2*a*. It is only beyond this position that the swing-action leg 2*a* is carried along as the removal movement continues, in which case the blocking leg 2*b*, which is coupled to the swing-action leg 2*a*, is moved out of its position between the U-shaped retaining means 1 and into the blocking position. The length and curvature of the blocking leg 2*b* may be coordinated with the size of the pack 10*a* or 10*b* located on the retaining means 1.

FIGS. 6A and 6B show a stop 4 which is arranged perpendicularly in relation to the U-shaped double rack hook 1 and serves as a stop for the blocking leg 2*b*. The stop 4 limits the movement of the blocking leg 2*b*, in order thus to regulate the position of the barrier 2 in the removal position E.

Figure 7A:
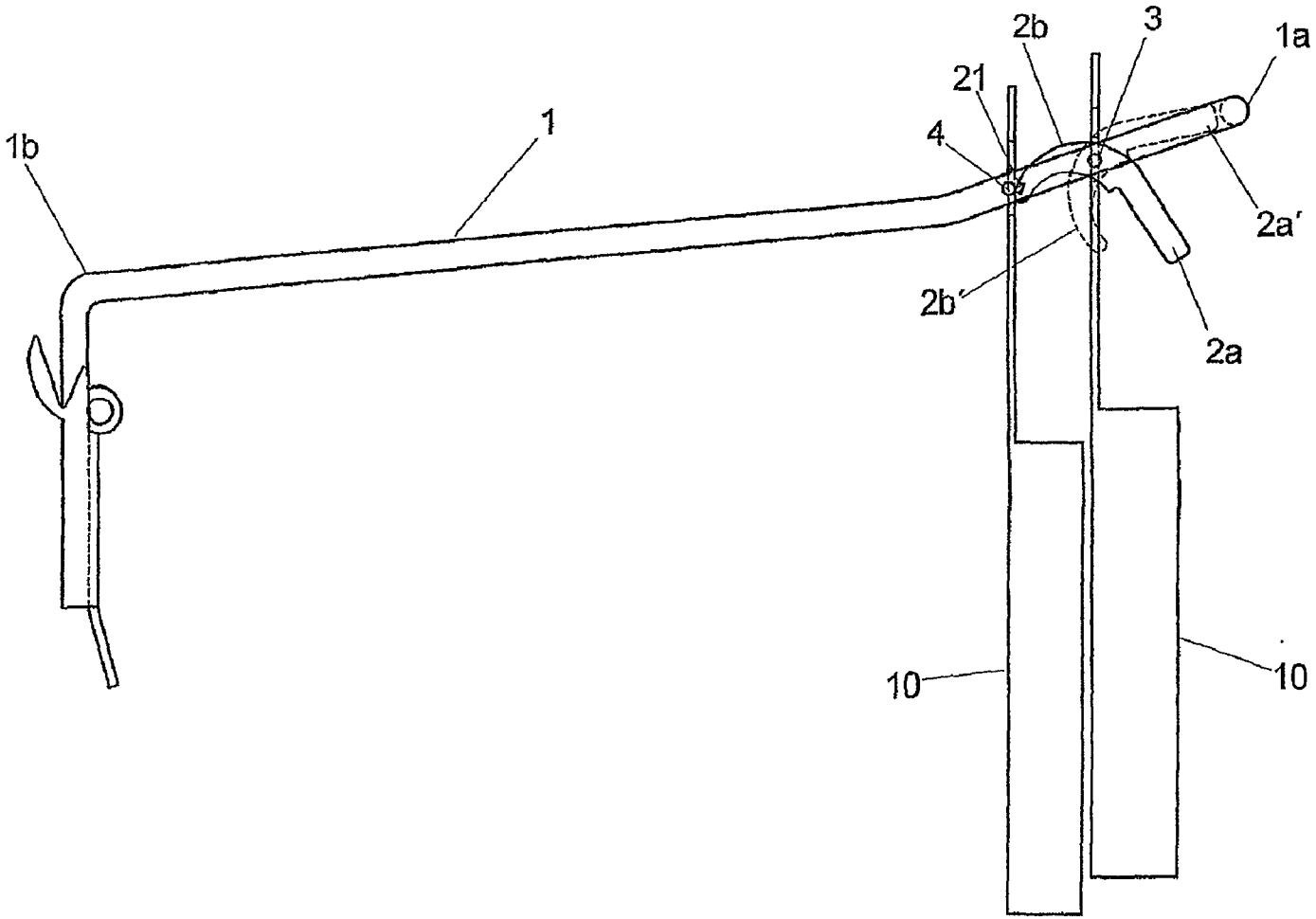
FIG. 7A shows a schematic section through a retaining means with a barrier, the retaining means being designed as a U-shaped double hook.
Figure 7B:
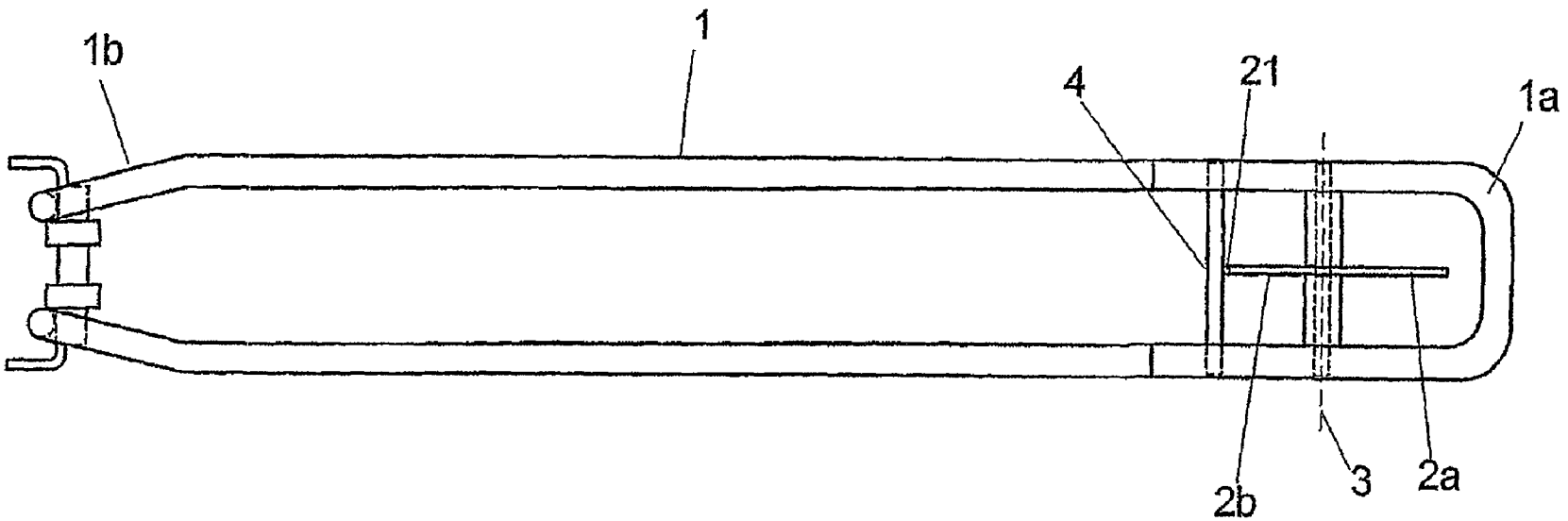
FIG. 7B shows a schematic plan view of the retaining means from FIG. 7A.

FIGS. 7A and 7B illustrate a further embodiment of a retaining means 1 with a barrier 2. At its open end 1*a*, the retaining means 1 is inclined upward in order to prevent the objects 10 from sliding down off the retaining means 1. In contrast to the exemplary embodiment of FIGS. 6A and 6B, the pivot axis 3 of the barrier 2 is spaced apart some way from the open end 1*a* in the direction of the wall end 1*b*.

The two legs 2*a* and 2*b* of the barrier 2 can be pivoted between the double rack hook of the retaining means 1. In the removal position, the blocking leg 2*b*—as seen in the side view in FIG. 7A—is located between the double rack hooks of the retaining means 1, and in the blocking position S the swing-action leg 2*a* is located here; as in the embodiment of FIGS. 6A and 6B, a stop 4, which defines the position of the barrier 2 in the removal position, is provided. It is likewise the case that the length and curvature of the blocking leg 2*b* are coordinated with the extent of the pack 10.

Figure 8A:
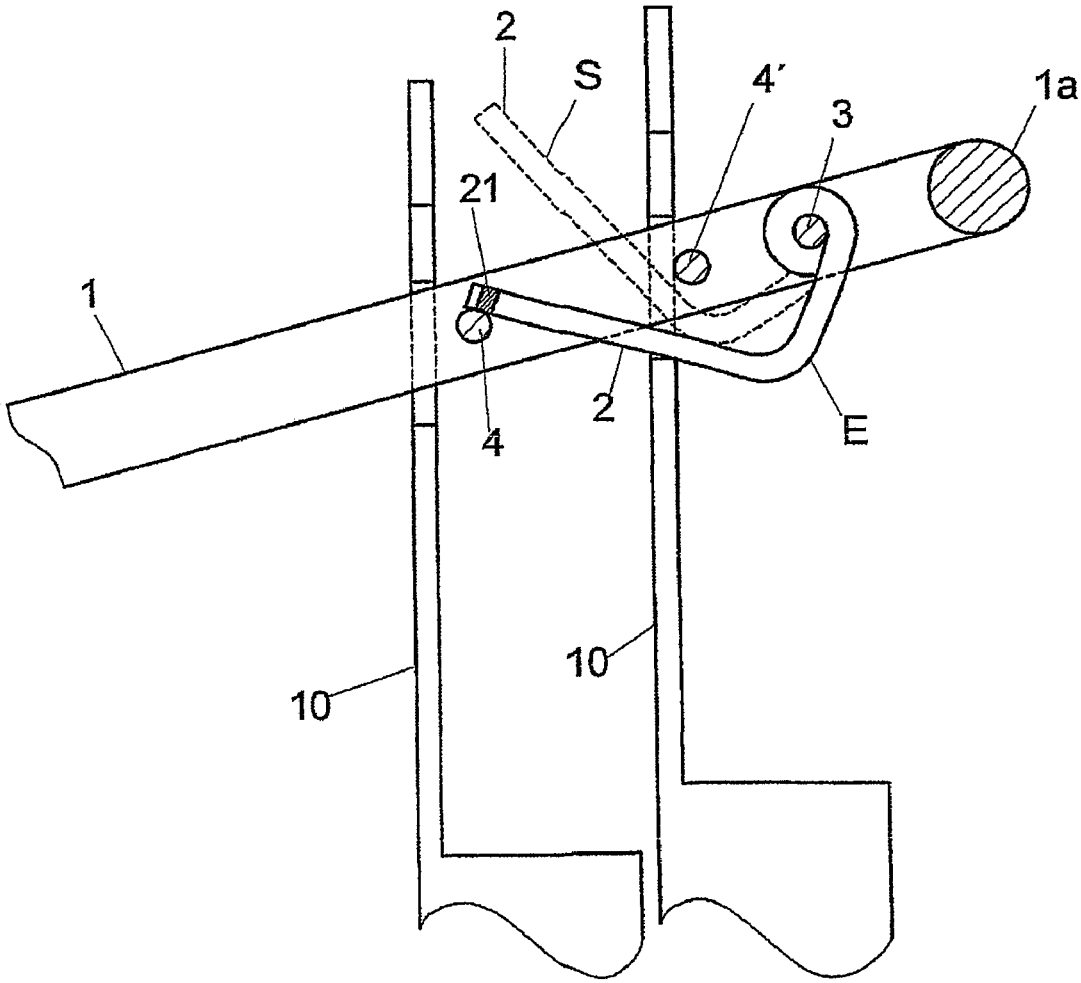
FIG. 8A shows a schematic section through a retaining means with a barrier which, in the blocking position, projects upward out of the retaining means.
Figure 8B:
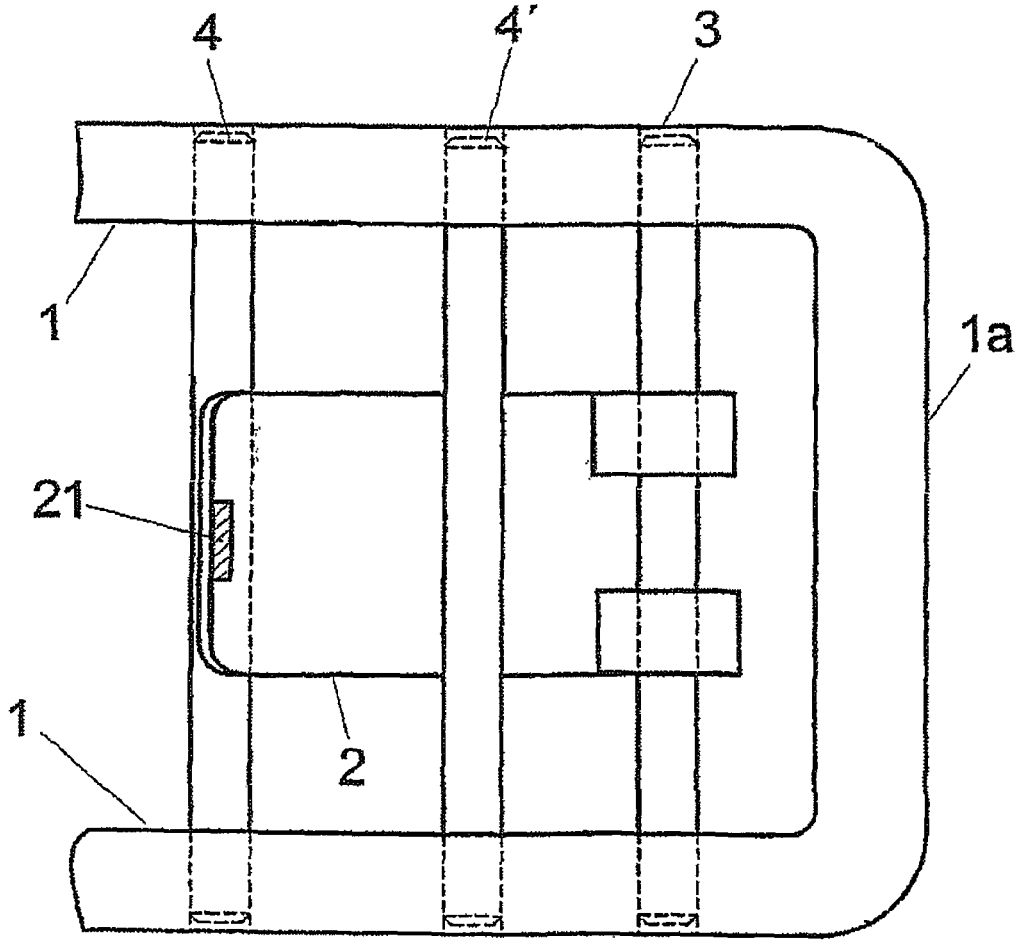
FIG. 8B shows a schematic plan view of the retaining means from FIG. 8A.

In the case of the exemplary embodiment which is shown in FIGS. 8A and 8B, the barrier 2 is likewise of L-shaped design and is mounted such that it can be rotated about the axis 3. In contrast to the previous exemplary embodiments, however, the barrier 2, rather than being rotatable at the vertex of the "L", is rotatable about the end of one of its L-legs.

In the removal position E, the first end of the barrier is arranged on the axis of rotation 3, while the second end of the barrier 2 butts against the stop 4 between the double rack hook of the retaining means 1. The L-bend of the barrier 2 here projects out of the double rack hook 1 on the underside thereof.

When an object 10 is removed from the retaining means 1, the object 10 comes into contact with the bend of the barrier 2 and forces it upward into the double rack hook 1. The barrier 2 here rotates about the axis 3 out of the removal position E into the blocking position S. A blocking stop 4' here limits movement of the barrier 2 in the direction of the blocking movement and prevents the barrier 2 from overturning or rotating excessively about the axis 3.

In the blocking position S, the first end of the barrier is still arranged on the axis of rotation 3, while the second end of the barrier 2 projects out of the double rack hook 1 of the retaining means 1 in the upward direction and, in its function as a barrier, prevents any further object 10 from being removed from the retaining means 1 as long as the barrier 2 is located in the blocking position S.

Figure 9:
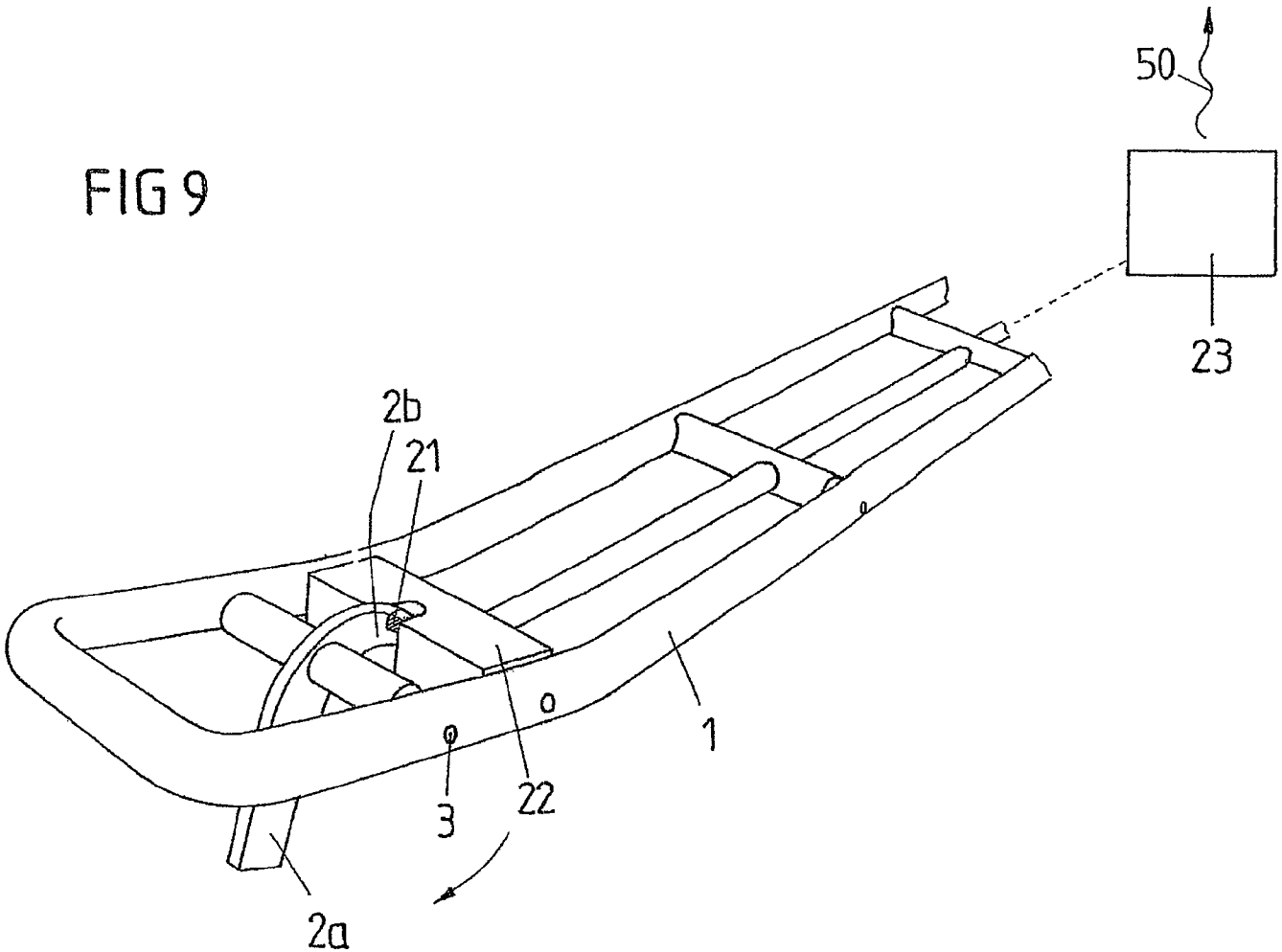
FIG. 9 shows a perspective view of a holder with a means for automatically determining the removal frequency.

It is also the case that the embodiments of FIGS. 5, 6, 7 and 8 each have a contact element 21 on the blocking leg 2*b*, this contact element being part of a means (not illustrated in full here) for determining the removal frequency (see FIG. 9). The means for sensing the removal frequency is then coupled to a control means, which can ultimately transmit a signal if a large-scale removal from the holder is inadmissibly taking place.

FIG. 9 illustrates a perspective view of an embodiment of the holder in which a means for separating objects (not illustrated here) is designed in the form of a swing-action mechanical barrier, as illustrated, for example, in FIG. 1.

As has already been described above, a contact element 21, which interacts with a contact-receiving means 22, is arranged on the blocking leg. Whenever the barrier 2 is rotated about the axis of rotation 3 in the direction of the arrow, the contact element 21 moves out of the contact-receiving means 22. In the state which is illustrated in FIG. 10, the contact element 21 is located in the contact-receiving means 22, in which case the contact is closed.

The contact-receiving means 22 may consist, for example, of plastic or brass.

There is magnetic interaction between the contact element 21 and contact-receiving means 22, in which case the alternating magnetic field can be used to determine whether or not the contact element 21 is located in the contact-receiving means 22. Optical or electronic interactions may also take place in alternative embodiments.

The contact element 21 and the contact-receiving means 22 together form a means for automatically determining the removal frequency at which at least one object is removed from and/or out of the holder. Removal frequency here is understood as being the operation for removing one object per unit of time. This also includes the operation for removing a single object within a relatively long period of time, e.g. the operation for removing an object during the night or the weekend.

Depending on the frequency at which the objects are removed from the holder, this results in corresponding field changes which are registered by a processor in the form of control means 23, the processor 23 activating a means for transmitting at least one signal in dependence on the removal frequency determined. The means for transmitting the signal here may be arranged, for example, in a housing on which the holders are fastened.

In a straightforward case, each removal operation can trigger an acoustic and/or optical signal. The signal can be triggered locally on the holder and/or for example in an office in a central monitoring location.

It is usually the case, however, that the removal operation will only trigger a signal if certain conditions which indicate that unauthorized removal of the objects is taking place are fulfilled. The means for transmitting the signal is coupled to the control means 23 (in this case a processor) and a signal is therefore triggered, for example, in the case of more than three removal operations taking place within 5 seconds.

The following describes a relatively complex plan which demonstrates the flexibility of the embodiment according to the invention:

1. Normal removal of the article (1st alarm stage, point 1): a short, quiet alarm sound should be generated upon each break in contact (corresponding to the removal of one article).

Duration of the alarm sound A1 seconds. Start setting: 1 second.

2. Quick removal operations in a short period of time (2nd alarm stage, point 2): in the case of X removal operations from the monitored holder within a period of time of Y to Z seconds, a loud alarm sound should be generated for A2 seconds. A light source should be switched on in addition. Start setting: 4 or more removal operations in 1 to 5 seconds. A2=30 seconds.

3. Slow removal operations over a relatively long period of time (2nd alarm stage, point 3): in the case of X1 removal operations in a period of time Y1 to Z1, the procedure should be as at 2.

Start setting: 8 or more removal operations in 1 to 30 seconds.

4. Manipulation (3rd alarm stage, point 4): if a contact should be broken for longer than W seconds, there should be a particularly loud and long alarm sound (A3 seconds) and, possibly in addition, a remote alarm, since manipulation is suspected and/or there is a malfunction. Start setting: W=4 seconds, A3=60 seconds.

5. Activity outside the shop-opening hours (3rd alarm stage, point 5): if even just one removal operation is carried out before C o'clock and/or after D o'clock, an alarm should sound as at 4.

Start setting: C 7:50 and D=20:10. Of course, the day of the week is also registered, in which case the operation of removing a single object on a Sunday likewise triggers the 3rd alarm stage.

This plan clearly shows that the means 21, 22 for determining the removal frequency, together with the control means 23, can trigger different signals 50 adapted to the respective reason for triggering. The means 21, 22, 23 may also be coupled, for example, to a clock in order for removal operations which are normal during opening hours to be detected outside the opening hours.

The device according to the invention can also be used for monitoring stock shortages, since it is recognized in the trade that avoiding stock shortages is important for success.

This is achieved in that, once the holder has been filled, a processor in the means for automatically determining the removal frequency is informed of the presence of a full stock by key actuation.

The removal operations for each holder are then registered by way of the contact between the contact element 21 and contact-receiving means 22, and the stock level is correspondingly reduced in the processor. It is thus the case that, in addition to preventing inadmissible removal operations, the system can also serve as a counter for the objects.

If the stock drops below a minimum level, a signal is emitted and a remote warning gives rise to the stock being replenished. This prevents the situation where there are no objects, or too few objects, on or in the holder.

FIG. 10 illustrates, schematically, a holder for objects in the form of a dispenser for decorative cosmetic products, e.g. lipsticks 10. Lipsticks or similar products are not usually displayed on hook-like holders, as illustrated in FIG. 9.

In this case, the holder has, as a retaining means, a box 1 with introduction openings 31 located at the top. The introduction openings 31 are arranged above shafts 32 into which the lipsticks 10 have been introduced. This region is covered toward the front by a transparent panel. Removal openings 33 are arranged at the bottom end of the shafts 32, and the lipsticks 10 can be removed individually therefrom.

Figure 10A:
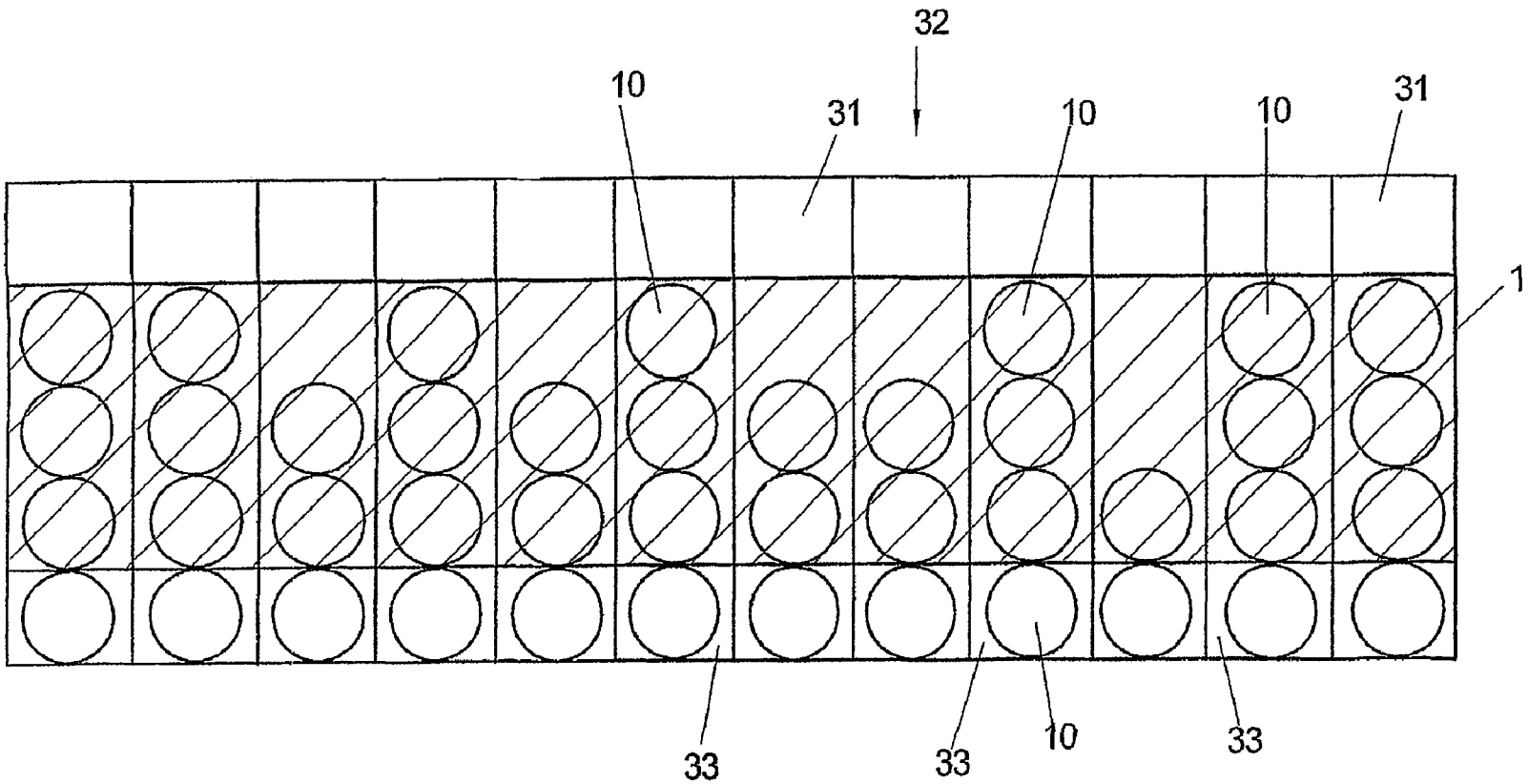
FIGS. 10A-E show illustrations of a further embodiment of a holder according to the invention.
Figure 10B:
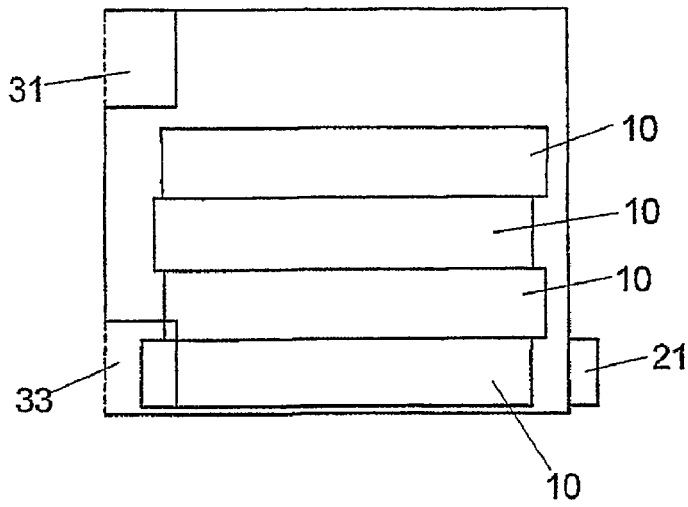
Figure 10C:
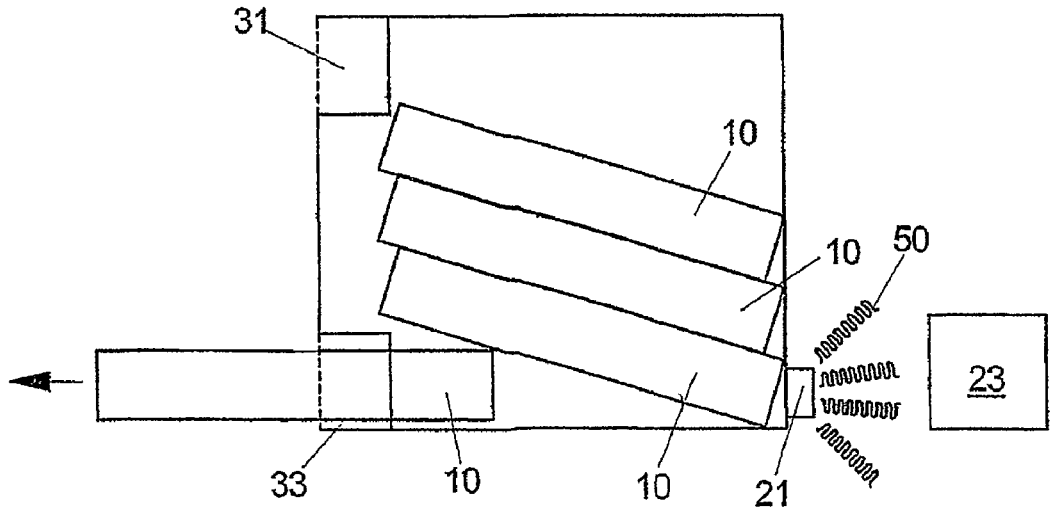

In order to prevent large-scale removal of lipsticks 10, it is also the case that this device is provided with a means 10 for automatically determining the removal frequency, one embodiment of which is illustrated in FIGS. 10B and 10C.

FIG. 10B illustrates a lateral sectional view of the holder according to FIG. 10A. The lipsticks 10 are located one above the other in a shaft 32. The removal opening 33 at the bottom end of the shaft 32 exposes part of a single lipstick 10, in which case the latter can be pulled out of the housing 1 of the holder.

A reflex sensor is arranged, in the form of a contact element 21, at the bottom end of the housing. The reflex sensor is designed as a laser-based distance sensor, although it is also basically possible to use some other distance-measuring principle.

This contact element 21 registers whether the lipstick 10 is moved relative to the contact element 21 in such a way that this should be understood as a removal operation. FIG. 10C illustrates a lipstick 10 just prior to being removed completely.

The contact element 21 here constitutes the means for automatically determining the removal frequency. For each removal operation, a processor coupled to the contact element 21 evaluates the removal frequency, and, in the case of a threshold value being exceeded, the control means 23 is therefore activated in dependence on the removal frequency determined and transmits a signal 50. In the case of large-scale removal of lipsticks a very loud acoustic signal can then be emitted, and this alerts the sales staff. In addition, or as an alternative, it is also possible for SMS messages, radio messages and/or e-mails to be sent automatically. In an analogous manner, this system can also be used for monitoring stock shortages, as has been described in conjunction with FIG. 9.

Figure 10D:
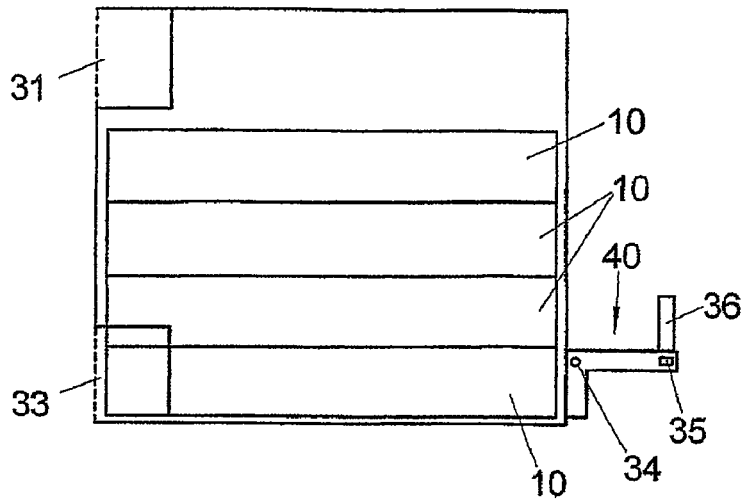
Figure 10E:
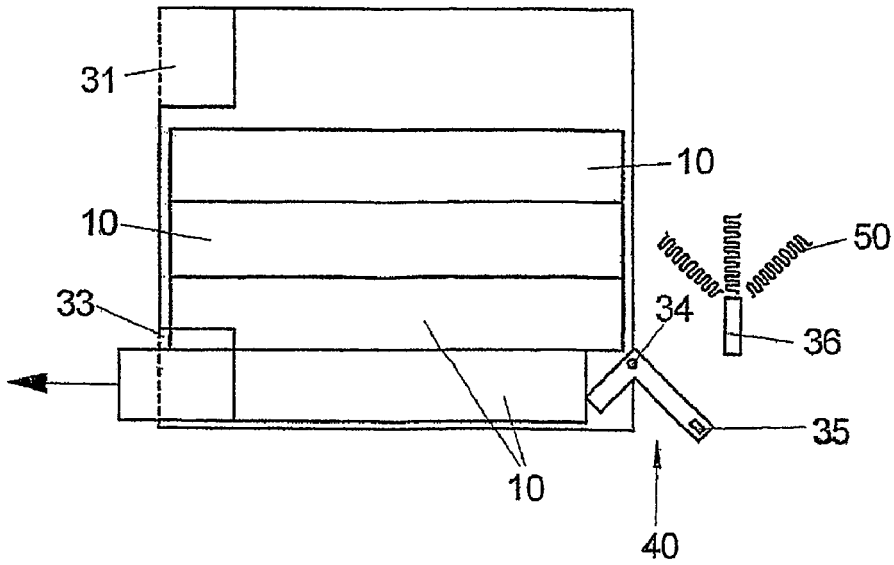

FIGS. 10D and 10E illustrate a modification of the embodiment according to FIGS. 10B and 10C, in which case reference can be made to the corresponding description.

The alternative according to FIGS. 10D and 10E differs by the means for automatically sensing the removal frequency being designed differently. FIG. 10D illustrates the lowermost lipstick 10 in its position prior to being removed.

A safeguarding rocker 40 is mounted such that it can be rotated about a pin 34. A magnet 35 is arranged on one arm of the safeguarding rocker 40, in which case it is connected to a reed contact when there are no removal operations taking place.

FIG. 10E illustrates a removal operation, a lipstick 10 being removed from the holder. The safeguarding rocker 40, which up until now has been supported on one of the lipsticks 10, pivots downward, in which case the magnet 35 is no longer in contact with the reed contact 36.

Following removal of the lipstick 10, a further lipstick 10 moves down the shaft 32 from above, this further lipstick pivoting the safeguarding rocker back in the other direction and, finally, re-establishing the contact with the reed contact 36. The reed contact 36 thus operates in a manner analogous to the contact element 21, which engages with the contact-receiving means 22; the principle is similar.

If lipsticks 10, then, are removed in quick succession from the holder, the removal frequency can be determined from the frequency of contact with the reed contact. As described in conjunction with FIG. 9, it is thus possible to detect inadmissible removal operations and/or also to determine a stock shortage in a shaft.

LIST OF DESIGNATIONS

1 Retaining means
1*a* Open end of the retaining means 1
1*b* End of the retaining means 1 which is fastened on a wall
1-1 Normal region of the retaining means 1
1-2 Thinned region of the retaining means 1
2 Barrier
2*a* Swing-action leg
2*b* Blocking leg
3 Axis of rotation
4 Stop
4' Blocking stop
10 Object
10*a* Object in normal-sized pack
10*b* Object in large pack
15 Threaded sleeve nut
16 Separating line
21 Contact element
22 Contact-receiving means
23 Control means
31 Introduction opening
32 Shaft
33 Removal opening
34 Pin
35 Magnet
36 Reed contact
40 Safeguarding rocker
50 Signal
E Removal position
S Blocking position
A Pivoting direction

The invention claimed is:

1. A holder for at least one object, in particular for articles or packs, the holder comprising:

means for automatically determining the removal frequency at which the at least one object is removed from and/or out of the holder, and control means for transmitting at least one signal in dependence on the removal frequency determined.

2. The holder as claimed in claim 1, wherein the means for automatically determining the removal frequency is coupled to a control means which automatically emits at least one signal if at least one predetermined threshold value for the removal frequency is exceeded.

3. The holder as claimed in claim 2, wherein the threshold value is a removal frequency of more than 3 removal operations per 5 seconds for removing an object from and/or out of the holder.

4. The holder as claimed in claim 2, wherein the threshold value is a removal frequency of more than 7 removal operations per 30 seconds for removing an object from and/or out of the holder.

5. The holder as claimed in claim 1, wherein at least one signal is a loud acoustic signal in the vicinity of the holder and/or an optical signal in the vicinity of the holder.

6. The holder as claimed in claim 1, wherein at least one signal is an acoustic and/or optical signal at a monitoring location remote from the holder.

7. The holder as claimed in claim 1, wherein at least one signal is a wireless radio signal, in particular an SMS message, a pager message, an e-mail and/or a radio message.

8. The holder as claimed in claim 1, wherein at least one signal is a triggering signal for a monitoring camera and/or a monitor.

9. The holder as claimed in claim 1, wherein the means for automatically determining the removal frequency is coupled to a clock, in which case the at least one signal is triggered in dependence on the time.

10. The holder as claimed in claim 1, wherein the object has at least one retaining opening, in which case a retaining means of the holder is configured to be guided through the retaining opening and retains the object.

11. The holder as claimed in claim 1, further comprising a mechanical device coupled to the at least one retaining means, the mechanical device being intended for separating the operations for removing an object and is coupled to the at least one means for automatically determining the removal frequency via an electromagnetic, magnetic, electronic and/or optical signal.

12. The holder as claimed in claim 11, wherein the mechanical device for separating objects is in the form of a removal opening of the holder.

13. The holder as claimed in claim 11, wherein a removal opening is arranged beneath an introduction opening for the objects, in which case the objects, under the action of gravitational force, are arranged in front of the removal opening.

14. The holder as claimed in claim 1, wherein the means for automatically determining the removal frequency has a reed contact.

15. The holder as claimed in claim 1, wherein the at least one mechanical barrier, in a removal position, allows the intended removal of an object from the retaining means and, in a blocking position, prevents the intended removal of an object from the retaining means.

16. The holder as claimed in claim 1, wherein the mechanical barrier, which is coupled to the one retaining means, is designed such that it is moved automatically from the removal position into the blocking position by the proper removal of an object from the retaining means.

17. The holder as claimed in claim 1, wherein the barrier is mounted for rotation about an axis such that it is moved from the removal position into the blocking position by a rotary movement about the axis upon proper removal of an object from the retaining means.

18. The holder as claimed in claim 1, wherein the barrier has a protrusion which, in the removal position, projects out of the retaining means such that it is subjected to mechanical contact, and moved, by the object upon proper removal of the latter from the retaining means, as a result of which the barrier is moved into the blocking position.

19. The holder as claimed in claim 1, wherein, in a not-in-use position, the barrier moves automatically into the removal position.

20. The holder as claimed in claim 1, wherein the barrier, in the blocking position, has at least one dimension which is larger than the at least one opening of the object, in which case the retaining means is restricted in movement through the opening in the blocking position.

21. The holder as claimed in claim 1, wherein the barrier has at least one blocking leg and a swing-action leg, which are coupled mechanically to one another.

22. The holder as claimed in claim 21, wherein the proper removal of an object from the at least one retaining means moves the swing-action leg such that the blocking leg is moved into the blocking position via the mechanical coupling to the swing-action leg.

23. The holder as claimed in claim 21, wherein the blocking leg, in the removal position, is oriented essentially parallel to the retaining means.

24. The holder as claimed in claim 21, wherein the blocking leg, in the removal position, is recessed in the retaining means.

25. The holder as claimed in claim 21, wherein the swing-action leg, in the removal position, is formed essentially perpendicularly to the retaining means.

26. The holder as claimed in claim 21, wherein the blocking leg, in the blocking position, is formed essentially perpendicularly to the retaining means.

27. The holder as claimed in claim 21, wherein the swing-action leg, in the blocking position, is formed essentially parallel to the retaining means.

28. The holder as claimed in claim 21, wherein the swing-action leg is designed to be heavier than the blocking leg.

29. The holder as claimed in claim 21, wherein the swing-action leg is designed to be longer than the blocking leg.

30. The holder as claimed in claim 21, wherein the holder is designed as a U-shaped double hook, between which at least one leg of the barrier is configured to move.

31. The holder as claimed in claim 21, wherein the swing-action leg is designed as an information carrier, in particular for a price tag.

32. The holder as claimed in claim 21, further comprising a stop for the blocking leg, the stop limiting movement of the blocking leg, in the removal position, in at least one direction and thus regulating the position of the barrier in the removal position.

33. The holder as claimed in claim 1, wherein the barrier is of essentially an L-shaped design.

34. The holder as claimed in claim 33, wherein the axis runs through the L-vertex of the barrier, and the barrier (2) is mounted such that it is configured to rotate about its L-vertex.

35. The holder as claimed in claim 33, wherein the axis runs through the end of one of the L-legs of the barrier, and the barrier is mounted such that it is configured to rotate about the end of its L-leg.

36. The holder as claimed in claim 1, wherein the barrier is fixed to the retaining means.

37. The holder as claimed in claim 1, wherein the retaining means is designed as a hook, in particular as a rack hook.

38. The holder as claimed in claim 1, wherein the barrier is arranged at the end of the retaining means, the object being moved via the end upon proper removal from the retaining means.

39. The holder as claimed in claim 1, wherein an acoustic signal is generated when the barrier is moved from the removal position into the blocking position.

40. The holder as claimed in claim 1, wherein the acoustic signal sound is triggered by an acoustic signal transmitter being subject to electronic contact, in the blocking position, by the swing-action leg.

41. The holder as claimed in claim 1, wherein the means for automatically determining the removal frequency is coupled to a means for monitoring stock.

* * * * *